US006145966A

United States Patent [19]

Hotomi et al.

[11] Patent Number: 6,145,966

[45] Date of Patent: Nov. 14, 2000

[54] INK JET RECORDING HEAD

[75] Inventors: Hideo Hotomi, Nishinomiya; Izumi Osawa, Ikeda, both of Japan

[73] Assignee: Minolta Co., Ltd., Osaka, Japan

[21] Appl. No.: 08/853,858

[22] Filed: May 9, 1997

[30] Foreign Application Priority Data

May 9, 1996 [JP] Japan ..... 8-114654

[51] Int. Cl.[7] ..... B41J 2/045

[52] U.S. Cl. ..... 347/70

[58] Field of Search ..... 347/70, 68; 310/330–332, 310/328

[56] References Cited

U.S. PATENT DOCUMENTS

| | | | |
|---|---|---|---|
| 5,144,342 | 9/1992 | Kubota | 346/140 R |
| 5,446,485 | 8/1995 | Usui et al. | 347/72 |
| 5,589,725 | 12/1996 | Haertling | 310/358 |
| 5,710,584 | 1/1998 | Suzuki et al. | 347/70 |
| 5,818,482 | 10/1998 | Ohta et al. | 347/70 |

FOREIGN PATENT DOCUMENTS

| | | |
|---|---|---|
| 4-52213 | 8/1992 | Japan . |
| 6-71878 | 3/1994 | Japan . |
| 2282992 | 4/1995 | United Kingdom . |

*Primary Examiner*—John Barlow
*Assistant Examiner*—Juanita Stephens
*Attorney, Agent, or Firm*—Sidley & Austin

[57] ABSTRACT

An ink-jet recording head (10) includes a plate (32,36) having a recess and a nozzle (38) fluidly communicated with the recess, a diaphragm (28) for covering the recess to form a cavity (34) with the plate for receiving an ink material (46), and an actuator (18) for vibrating to force the diaphragm to eject the ink material through the nozzle. Also, the diaphragm is pre-tensioned so that the diaphragm continues to deform elastically in response to vibrations of said actuator. Preferably, the diaphragm is pre-tensioned to have an elongation percentage of 0.15 to 3%.

18 Claims, 5 Drawing Sheets

Fig. 8

MATERIALS OF DIAPHRAGM AND PROPER ELONGATION PERCENTAGE

| Number | Material/ thickness | Modulus of elasticity ($kgf/mm^2$) | Manufacturer /item number | Embodiment 1 | Embodiment 2 | Embodiment 3 |
|---|---|---|---|---|---|---|
| 1 | nickel 10 μm | 21,000 | EPS Giken -- | 0.2 - 1 % | 0.25 - 1 % | 0.4 - 1 % |
| 2 | stainless steel 10 μm | 17,000 | EPS Giken SUS #304 | 0.15 - 1 % | 0.2 - 1 % | 0.3 - 1 % |
| 3 | polyimide 10 μm | 300 | Toray Industries, Inc. Kapton film | 0.15 - 3 % | 0.15 - 3 % | 0.8 - 3 % |
| 4 | aramid 10 μm | 400 | Toray Industries, Inc. Lumirror S10 | 0.25 - 2 % | 0.3 - 2 % | 0.5 - 2 % |
| 5 | polyphenylen sulfide 10 μm | 250 | Toray Industries, Inc. TORELINA | 0.25 - 2 % | 0.3 - 2 % | 0.5 - 2 % |

INK JET RECORDING HEAD

BACKGROUND OF THE INVENTION

The present invention relates to an ink jet recording head for use in an ink-jet printer, and particularly to an ink jet recording head in which an ink material is pressurized by a vibration of an actuator and then ejected.

There has been proposed an ink-jet recording head which comprises a head body having a recess and a nozzle fluidly communicated with the recess, a diaphragm covering the recess to form an ink cavity with the head body for receiving an ink material, and a piezo-electric actuator arranged adjacent the diaphragm to oppose the ink cavity. Typically, in this ink-jet recording head, the diaphragm is bonded by an adhesive, and the piezo-electric actuator is fixed in contact with or slightly spaced away from the diaphragm. In operation of the ink-jet recording head, the piezo-electric actuator is vibrated and the vibration is transmitted to the diaphragm, thereby the ink material is pressurized and thus ejected through the nozzle into the atmosphere.

The ink-jet recording head is effective for ejecting the ink material, but has a serious problem that a deformation energy of the piezo-electric actuator is not fully transmitted to the ink material due to a pressure loss at the diaphragm, thereby decreasing a force for ink ejection. Specifically, initially the diaphragm is well tensioned and therefore the vibration of the piezo-electric actuator is fully transmitted to the ink material through the diaphragm, however, the diaphragm deteriorates, or creeps, over time to lose its initial tension, which causes a pressure loss at the diaphragm or cracks in the diaphragm.

SUMMARY OF THE INVENTION

Accordingly, the primary object of the instant invention is to provide an improved ink-jet recording head in which an ink material can establish a stable ink ejection.

Generally, the ink-jet recording head of the invention includes a plate having a recess and a nozzle fluidly communicated with the recess, a diaphragm for covering the recess to form a cavity with the plate for receiving an ink material, and an actuator for vibrating to force the diaphragm to eject the ink material through the nozzle. Also, the diaphragm is pre-tensioned so that the diaphragm continues to deform elastically in response to vibrations of said actuator. Preferably, the diaphragm is pre-tensioned to have an elongation percentage of 0.15 to 3%. The elongation percentage is given by the following equation:

$$E=(\Delta L/L)\cdot 100(\%)$$

wherein E represents the elongation percentage, ΔL represents the elongation, and L represents the original length of the diaphragm before being stretched.

In accordance with the invention, because the diaphragm is pre-tensioned, the deformation energy of the actuator is fully transmitted to the diaphragm and then to the ink material in the cavity. Also, the pre-tension is induced in the diaphragm so that the diaphragm deforms elastically in response to the vibrations of the actuator, and therefore the vibrations of the actuator can be transmitted to the diaphragm and to the ink material without any loss of the deformation energy regardless of a long time of use. Thus, a constant ink ejection can be established over the service life of the ink-jet recording head. Also, ink dots of a constant diameter can be deposited on a sheet substrate, thereby resulting in a high quality image.

BRIEF DESCRIPTION OF THE DRAWINGS

FIG. 8 is a table which shows materials for the diaphragm and their elongation.

DETAILED DESCRIPTION OF THE PREFERRED EMBODIMENTS

Figure 1:
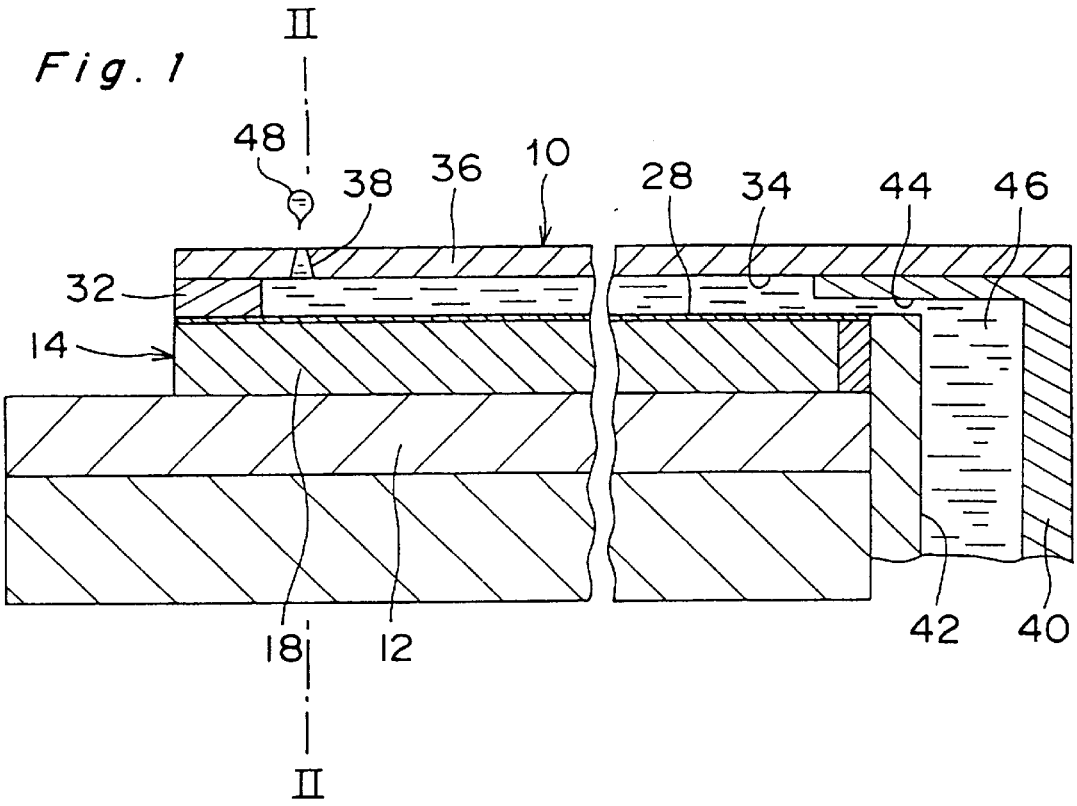
FIG. 1 is a longitudinal cross-sectional side elevational view of an ink jet head of the invention.
Figure 2:
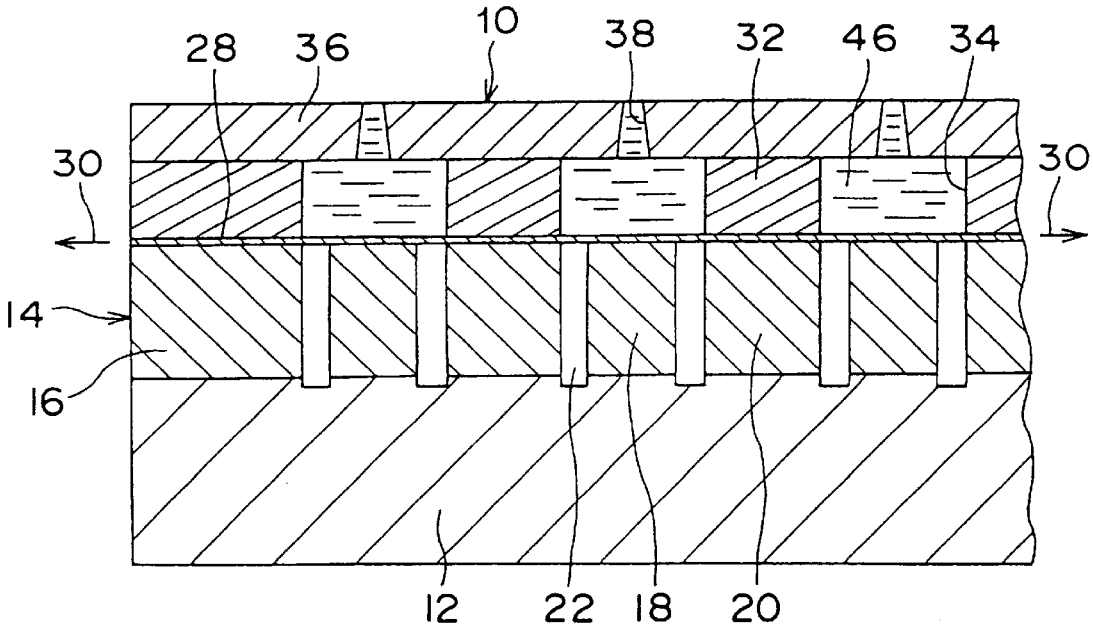
FIG. 2 is a transverse cross-sectional side elevational view taken along the line II—II in FIG. 1.
Figure 3A:
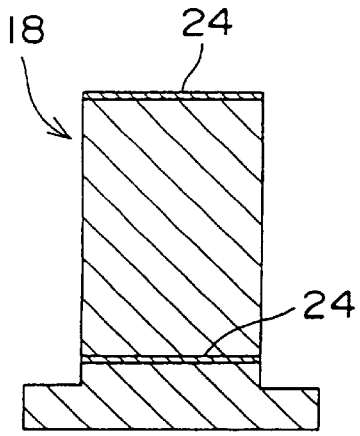
FIGS. 3(*a*) to (*c*) are transverse cross-sectional views of the piezo-electric actuators in which the piezo-electric actuators in FIGS. 3(*a*) to 3(*c*) have single, double, and multiple layers, respectively.
Figure 3B:
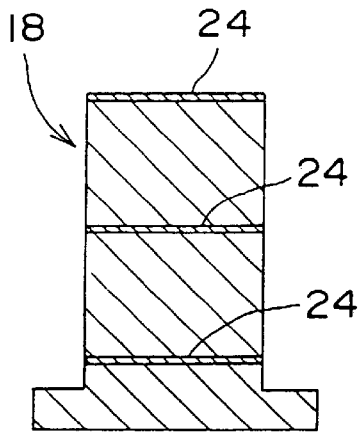
Figure 3C:
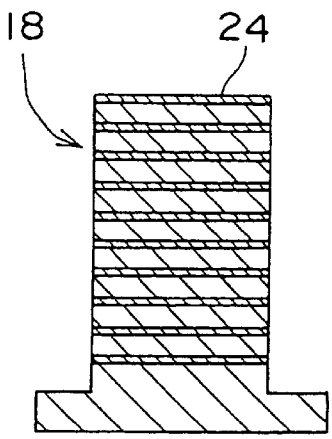

With reference to the drawings, particularly in FIGS. 1 and 2, there is shown an ink-jet recording head generally indicated by reference numeral 10. The ink-jet recording head 10 includes a base 12 made of non-piezo-electric material on which a piezo-electric vibrating member 14 is mounted. The vibrating member 14, which is made from a plate of piezo-electric material, is cut into a plurality of elongated parallel portions including, supporting portions 16 (one supporting portion is not shown) at opposite sides, piezo-electric actuators 18, and partitions 20 each located between neighboring actuators 18, with leaving spaces 22 between adjacent portions. As shown in FIG. 3(*a*), the piezo-electric actuator 18 has at its upper and lower surfaces respective electrodes 24. A portion of the piezo-electric actuator 18 which is nipped by the opposing electrodes 24 is polarized by applying a high voltage between the electrodes 24 so that, if a voltage is applied between the electrodes 24, the piezo-electric actuator 18 will deform in a vertical direction.

Referring again to FIGS. 1 and 2, a diaphragm 28 is mounted on the piezo-electric vibrating member 14. The diaphragm 28, which is a film-like sheet made of metal or resin, is bonded between the vibrating member 14 and a channel plate 32. The diagram 28 is stretched with a certain tensile force in opposite directions indicated by reference numerals 30 which are perpendicular to an axis of the elongated piezo-electric member 18. The tensile force is determined so that no harmful effect will be provided to the deformation of the piezo-electric member 18, the diaphragm 28 will follow the deformation of the piezo-electric member 18 while keeping its elasticity, and no crack will be created by the predetermined number of repeated stresses (depending upon its thickness and material). Preferably, the initial stress is applied so that the an elongation percentage of the diaphragm 28, defined by the following equation, is 0.15% or more:

$$E=(\Delta L/L)\cdot 100(\%)$$

wherein E represents the elongation percentage, ΔL represents the elongation, and L is the original length of the diaphragm before being stretched. Also, preferably, the maximum elongation percentage by the initial stretching is less 3.0%. More preferably, the maximum elongation percentage is less than 1.0% if the diaphragm is made of metal, and less than 3.0% if it is made of resin.

The initial tensile force may be induced in the diaphragm in different ways. For example, firstly the diaphragm is stretched in opposite directions indicated by reference numerals 30 and then bonded to both the channel plate 32 and piezo-electric actuators 18.

The channel plate 32, which is made of non-piezo-electric material, is formed with a plurality of parallel ink cavities 34. As can be seen from FIG. 2, the ink cavities 34 are spaced at the same regular intervals as the piezo-electric members 18. Preferably, the width of the ink cavity 34 is almost equal to a distance between two neighboring partitions 20. The channel plate 32 so constructed is bonded on the diaphragm 28 so that the ink cavity 34 is located on and along the piezo-electric actuator 18.

A nozzle plate 36, which is bonded on the channel plate 32 so as to cover the ink cavities 34, includes a plurality of nozzles 38 adjacent to one ends (left ends in FIG. 1) of respective ink cavities 34 for ejecting an ink material received in the ink cavities 34. Although, the channel and nozzle plates 32 and 36 are separate members in this embodiment, they may also be integrated into a single plate.

An ink tank 40 is provided on the opposite side (right side in FIG. 1) of the recording head, in which an ink chamber 42 is fluidly communicated with the ink cavities 34 through associated ink inlets 44 so that an ink material 46 received in the ink chamber 42 can be supplied to the ink cavities 34.

In operation of the ink-jet recording head 10 so constructed, when a signal for printing is applied to the electrodes 24 from a print instruction unit (not shown), the piezo-electric member 18 deforms in the vertical direction. Then, the diaphragm 28 follows the deformation to pressurize the ink material 46 in the ink cavity 34, which results in an ejection of an ink droplet 48 through the nozzle 38. Then, when the signal is turned off, the piezo-electric member 18 and, in turn, the diaphragm 28 take initial shapes or positions, respectively. At this moment, a negative pressure is induced in the ink cavity 34, whereby the ink material 46 is supplied to the ink cavity 34 from the ink chamber 42 through the ink inlet 44.

As described above, the diaphragm 28 is pre-tensioned at the time of its assembling and it can maintain a certain tension and will not sag even after a great number of deformations thereof in response to the repeated deformations of the piezo-electric members 18. The diaphragm 28 unavoidably loses a small part of its initially induced tension through use. Also, the initial tension is carefully determined that the diaphragm 28 can follow the deformation of the piezo-electric member 18 with keeping its elasticity, and therefore the diaphragm 28 will never crack even if it could be vibrated over time.

Figure 4:
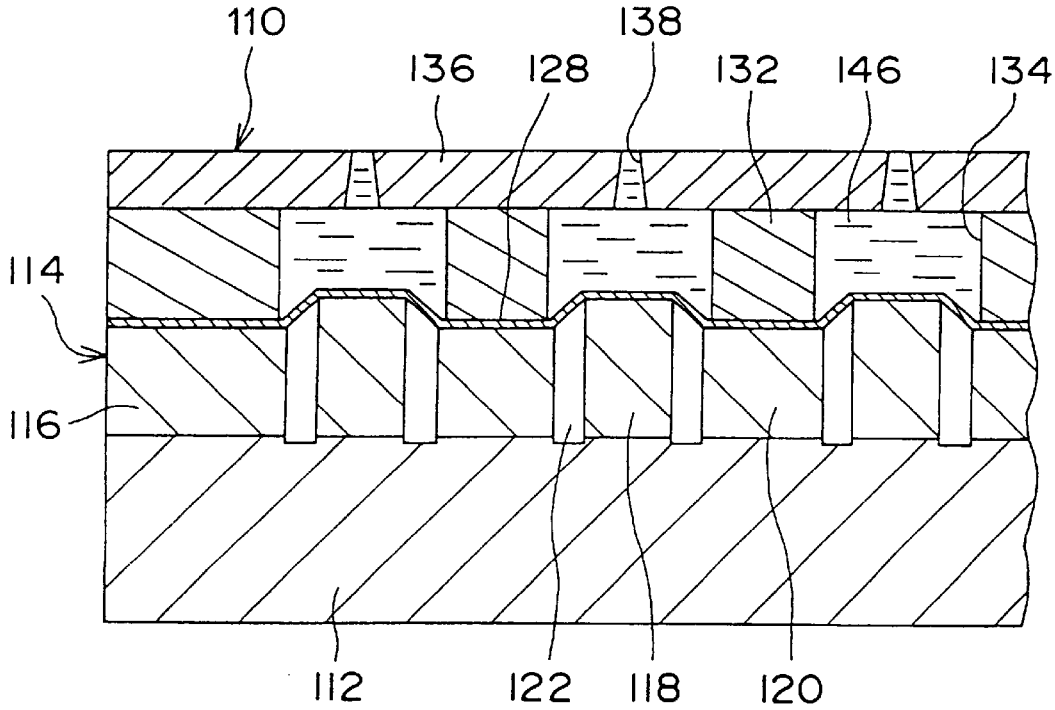
FIG. 4 is a transverse cross-sectional view of the ink-jet recording head of the second embodiment.

Referring to FIG. 4, there is shown an ink-jet recording head 110 of a second embodiment according to the invention, in which reference numerals each added one hundred are provided to like parts in the first embodiment. In this ink-jet recording head 110, the piezo-electric actuator 118 is designed to be higher than the partitions 120 so that it is extended into the associated ink-cavity 134. The diaphragm 128 is also pre-tensioned at its assembling in a suitable manner. For example, the diaphragm 128 is first bonded on the lower surface of the channel plate 132. At this time, no tension is induced in the diaphragm 128. Next, the piezo-electric member 114 is forced onto the diaphragm 128 while forcing portions of the diaphragm 128 being in contact with the piezo-electric actuators 118 into the ink cavities 134, respectively, thereby providing the diaphragm 128 with a certain tension. Finally, the piezo-electric member 114 is bonded on the diaphragm 128 by an adhesive which has been applied on diaphragm 128 or piezo-electric member 114. According to this embodiment, the ink-jet recording head 110 can be assembled more easily.

Figure 5:
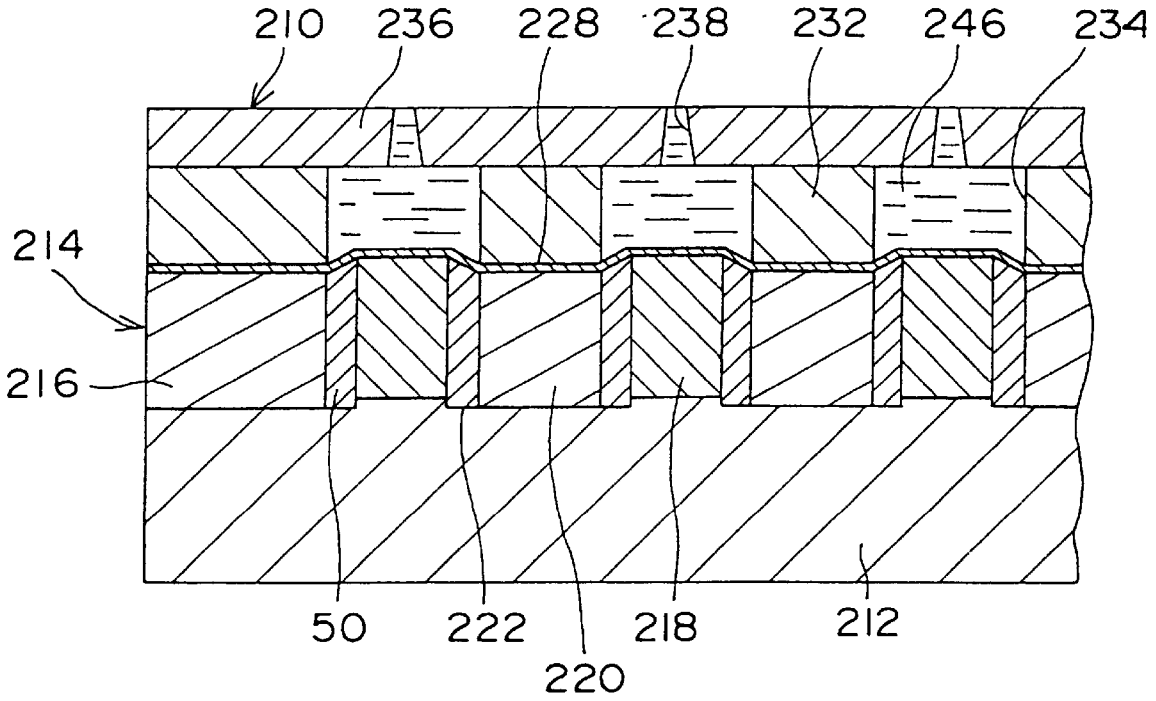
FIG. 5 is a transverse cross-sectional view of the ink-jet recording head of the third embodiment.

Referring to FIG. 5, there is shown an ink-jet recording head 210 of a third embodiment according to the invention, in which reference numerals each added two hundred are provided to like parts in the first embodiment. The ink-jet recording head 210 is an improvement of the second embodiment, in which each space 222 between the piezo-electric actuator 218 and the partition 220 is filled up by a suitable filler 50. With this filler 50, the piezo-electric actuator 118 is prohibited from deforming towards the partitions 220, which increases the deformation of the piezo-electric actuator 118 in the vertical direction towards the diaphragm 228 and, in turn, the pressure induced in the ink material for its ejection.

Although a single layered piezo-electric actuator having electrodes 24 on its upper and lower surfaces, respectively, is employed in the previous embodiments, it may also be a multi-layered piezo-electric member as shown in FIGS. 3(*b*) and 3(*c*). These multi-layered piezo-electric vibrating members can be produced by alternately superimposing a plurality of electrodes and piezo-electric layers.

Figure 6:
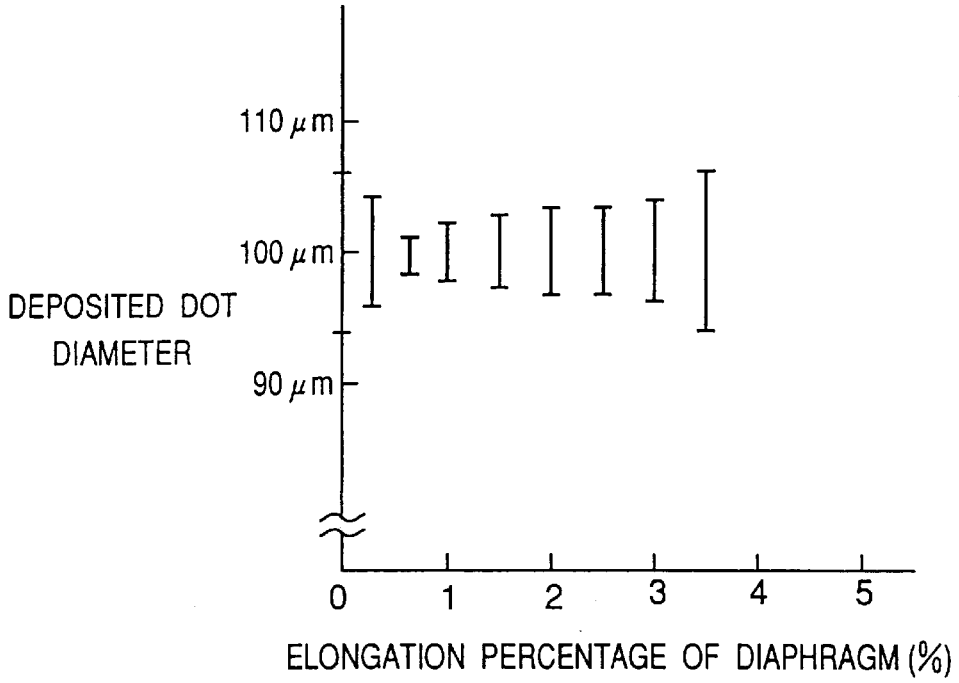
FIG. 6 is a graph which shows a relationship of an elongation of a diaphragm versus a dot size deposited on a sheet.

Using the ink-jet recording head of the second embodiment, tests were made to determine the relationship between initial elongation percentages of the diaphragm and the diameters of ink dot deposited on a sheet substrate, using a diaphragm made from a film of polyimide, having a thickness of 10 micron millimeters. The piezo-electric actuator used in the tests was a multi-layered (having ten layers) piezo-electric member. The ink was successively ejected by the application of a pulse signal between the electrodes having the maximum voltage of 35 volts and a period of 30 micro second. The results are illustrated in FIG. 6 which shows that the variation in the diameters of the deposited dots is decreased especially in the range of the initial elongation percentage of 0.15 to 3% of the diaphragm.

Figure 7:
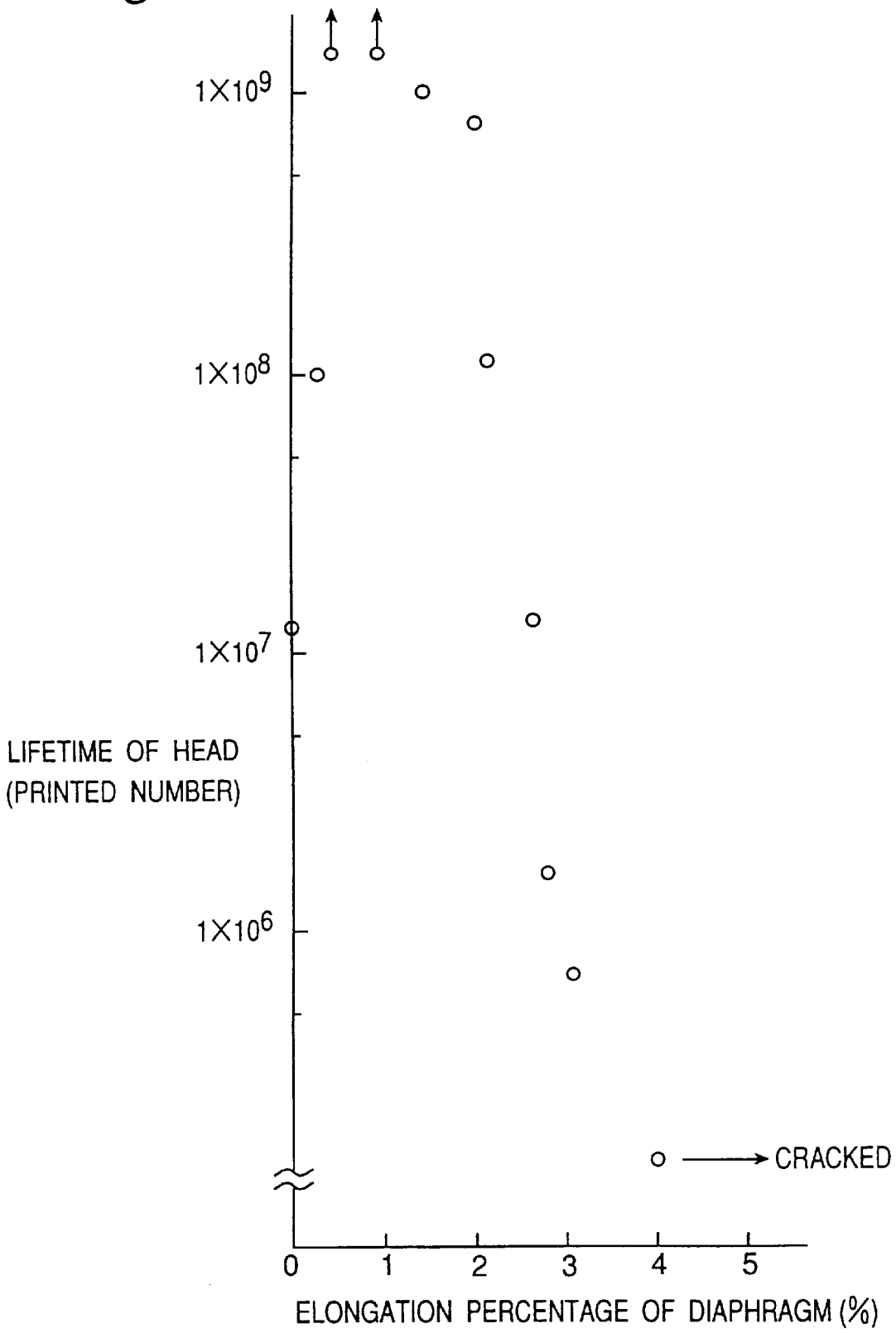
FIG. 7 is a graph which shows a relationship of the elongation of the diaphragm versus a duration of the ink-jet recording head.

A continuous printing test was performed with use of the same recording head to examine the relationship of between the initial elongation percentages and the lifetimes of the recording head. As a result of the test, as shown in FIG. 7, there exists a range of the elongation percentage of the diaphragm which allows the lifetime of the head to be extremely extended, and it was found that the elongation percentages of the diaphragm exceeding the range cause the lifetime of the head to decrease sharply. In the range of the elongation percentage from 0.15 to 2.5%, especially, long lifetimes of the head not less than $1\times10^8$ in the number of printing were recorded. In the case of the initial elongation percentages not less than 4%, the diaphragm cracked.

Another test were performed on various materials of the diaphragm to determine preferred initial stress (or initial elongation percentages) of the diaphragm with respect to the recording head in each embodiment. As a result of the test, as shown in FIG. 8, it was found that the initial elongation percentage should be adjusted between 0.15 and 1% for metal diaphragms and between 0.15 and 3% for resin diaphragms.

Although the present invention has been fully described by way of examples with reference to the accompanying drawings, it is to be noted that various changes and modifications will be apparent to those skill in the art. Therefore, unless otherwise such changes and modifications depart from the scope of the present invention, they should be constructed as being included therein.

What is claimed is:

1. An ink-jet recording head for use in an ink-jet printer, comprising:

a plate having a recess and a nozzle fluidly communicated with said recess;

a diaphragm covering said recess so as to form a cavity, said cavity for receiving an ink material; and an actuator for vibrating said diaphragm so as to force said diaphragm to eject ink material in said cavity through said nozzle;

wherein said diaphragm is pre-tensioned so that the diaphragm continues to be under tension even when said actuator is not vibrating said diaphragm, so that the diaphragm deforms elastically in response to vibrations of said actuator.

2. An ink-jet recording head in accordance with claim 1, wherein said diaphragm is pre-tensioned so as to have an elongation percentage in the range of approximately 0.15% to approximately 3%, said elongation percentage being given by the following equation:

$$E=(\Delta L/L)\cdot 100$$

wherein E represents the elongation percentage, ΔL represents the elongation, and L represents an original length of the diaphragm before being pre-tensioned.

3. An ink-jet recording head in accordance with claim 2, wherein said diaphragm is made of resin.

4. An ink-jet recording head in accordance with claim 3, wherein said diaphragm is made of polyimide.

5. An ink-jet recording head in accordance with claim 3, wherein said diaphragm is made of aramid.

6. An ink-jet recording head in accordance with claim 3, wherein said diaphragm is made of polyphenylen sulfide.

7. An ink-jet recording head in accordance with claim 2, wherein said diaphragm is made of metal.

8. An ink-jet recording head in accordance with claim 7, wherein said elongation percentage is between approximately 0.15% and approximately 1%.

9. An ink-jet recording head in accordance with claim 8, wherein said diaphragm is made of nickel.

10. An ink-jet recording head in accordance with claim 8, wherein said diaphragm is made of stainless steel.

11. An ink-jet recording head in accordance with claim 2, wherein said elongation percentage is between approximately 0.15% and approximately 2.5%.

12. An ink-jet recording head in accordance with claim 1, wherein said actuator includes a single layered piezo-electric actuator having electrodes on opposing surfaces thereof.

13. An ink-jet recording head in accordance with claim 1, wherein said actuator includes a multi-layered piezo-electric vibrating member which comprises a plurality of alternating superimposed layers of electrodes and piezo-electric layers.

14. An ink-jet recording head for use in an ink-jet printer, comprising:

a plate having a recess and having a nozzle fluidly communicating with said recess;

a diaphragm disposed on said plate which covers said recess so as to form a cavity, said cavity for receiving an ink material therein; and an actuator for selectably pressing on said diaphragm so as to eject ink material in said cavity through said nozzle;

wherein said diaphragm is fixed on said plate so to be maintained in a state of tension in the absence of said actuator selectably pressing on said diaphragm.

15. An ink-jet recording head for use in an ink-jet printer, comprising:

a plate having a recess and having a nozzle fluidly communicating with said recess;

a diaphragm disposed on said plate which covers said recess so as to form a cavity, said cavity for receiving an ink material therein; and an actuator, responsive to an applied signal, for selectably pressing on said diaphragm so as to eject ink material in said cavity through said nozzle;

wherein said diaphragm is adapted to deform elastically in response to said actuator selectably pressing thereon, and wherein said diaphragm is fixed on said plate so to be maintained in a state of tension even in the absence of said actuator selectably pressing on said diaphragm.

16. An ink-jet recording head in accordance with claim 15, wherein said actuator is a piezoelectric member which is adapted to deform in response to said applied signal.

17. An ink-jet recording head for use in an ink-jet printer, comprising:

a plate having a plurality of recesses, each recess having a nozzle fluidly communicating therewith;

a diaphragm disposed on said plate which covers said plurality of recesses so as to form a plurality of corresponding cavities, said plurality of cavities for receiving an ink material therein; and a plurality of actuators for selectably pressing on said diaphragm so as to eject ink material through said corresponding nozzles;

wherein said diaphragm is fixed on said plate so to be maintained in a state of tension in the absence of any of said plurality of actuators selectably pressing on said diaphragm.

18. An ink-jet recording head in accordance with claim 17, wherein each of said plurality of actuators are spaced apart from others of said plurality of actuators, a space between adjacent spaced apart actuators being filled with a filler material.

* * * * *